128-24 A AU 335 EX
11/14/78 XR 4,125,112

United States Patent [19]
Weihs

[11] 4,125,112
[45] Nov. 14, 1978

[54] TRANSMISSION MEMBERS FOR ELECTRO-VIBRATORY MASSAGE APPLIANCES

[76] Inventor: Edith Weihs, 23 Siedlungsstrasse, D-7911 Burlafingen, Fed. Rep. of Germany

[21] Appl. No.: 741,336

[22] Filed: Nov. 12, 1976

[30] Foreign Application Priority Data

Nov. 14, 1975 [DE] Fed. Rep. of Germany ..... 2551107

[51] Int. Cl.[2] ..... A61H 1/00
[52] U.S. Cl. ..... 128/32; 128/24 A; 128/64
[58] Field of Search ..... 128/24 R, 24 A, 32–36, 128/41, 38–40, 64

[56] References Cited

U.S. PATENT DOCUMENTS

| | | | |
|---|---|---|---|
| 2,920,617 | 1/1960 | Boiarsky | 128/24 A |
| 3,085,568 | 4/1963 | Whitesell | 128/33 |
| 3,356,086 | 12/1967 | Behney | 128/24 A |
| 3,705,578 | 12/1972 | Cutler et al. | 128/64 |
| 3,872,526 | 3/1975 | Betts | 128/33 |

*Primary Examiner*—Lawrence W. Trapp
*Attorney, Agent, or Firm*—Andrus, Sceales, Starke & Sawall

[57] ABSTRACT

A transmission member for an electrovibratory massage appliance, whereby the electrovibration may be transmitted to the human body comprises a fluid-filled member preferably formed from an elastics material. The fluid-filled member is provided with a closable aperture for the filling and draining of fluid. Also the fluid-filled member incorporates a vibration portion comprising either a mounting for a vibratory source or a permanently attached vibration source. When the vibratory source associated with the transmission member is switched on vibrations are transmitted to the external surface of the fluid-filled member through the liquid contained therein. Variations in the degreee of vibrations transmitted may be achieved by providing a composite transmission member having two or more fluid-filled members and by providing more than one vibration source.

11 Claims, 4 Drawing Figures

TRANSMISSION MEMBERS FOR ELECTRO-VIBRATORY MASSAGE APPLIANCES

Figure 1:
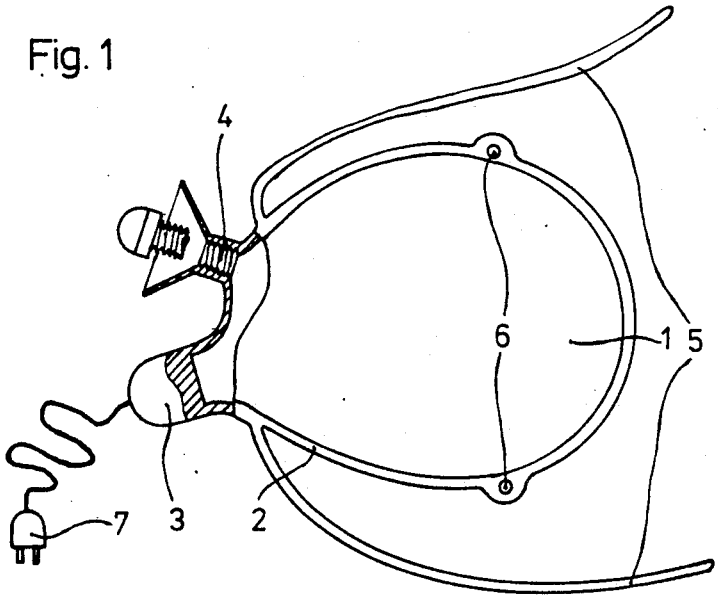

This invention relates to electrovibratory massage appliances and particularly to a transmission member by which the vibration is transmitted to the human body.

With a known electrovibratory massage appliance vibration is transmitted to the body by connecting to the vibration source a transmission member which takes over the vibratory oscillations and passes them to the human body upon contact with the latter. This member can be rigidly or detachably connected to the vibration source. In known devices both the rigidly connected and the detachable transmission members consist of solid plastics material, rubber or other solid materials.

The vibration inertia of the solid materials of the transmission member for a known electrovibratory massage appliance requires a powerful source of vibrations in order to cause the whole of the mass of the material to vibrate with sufficient power for massage purposes. Therefore, for electrovibratory massage, the transmission member is constructed to be as small as possible, since a small volume of material is more easily caused to vibrate with adequate power. Thus there is no opportunity for adaptation of the transmission member to the various forms suitable for treatment of all the parts of the body which are required to be treated.

Because of the hard primary vibration of the vibration source and its own rigid material consistency, the vibratory oscillations of the transmission member are also short and hard and these short and hard vibratory oscillations cannot be universally applied for massage purposes. Also, during massage treatment, the transmission member has to be moved back and forth since, if the electrovibration which is thus transmitted is allowed to act for any prolonged period on one location on the body, it will be very quickly found to be very unpleasant and may even cause pain, although it has been proposed that the hard vibratory oscillations may be dampened by using solid rubber transmission members.

It is an object of this invention to provide a transmission member for transmitting electrovibration which alleviates the above problems.

Accordingly this invention provides a transmission member for an electrovibratory massage appliance, whereby the electrovibration may be transmitted to the human body, wherein the transmission member incorporates a vibration portion comprising either a mounting for a vibration source, or a permanently attached vibration source, and wherein the transmission member comprises a fluid-filled member having a closable aperture for the filling and draining of fluid.

Thus the invention provides a new way of transmitting electrovibration, to the human body for massage purposes, which converts the hard electrovibration to gentle vibratory oscillations which are kinder to the body, so that such vibratory massage can be allowed to act even for a prolonged period on one place on the body without any unpleasant side effects. As an added advantage the transmission member of the invention for transmitting electrovibration can be of a large area and thus be adapted to the form of whichever part of the body is being treated and furthermore, during massage, the part of the body being massaged can be cooled or heated as required.

The important advantage of the invention is that there is provided, between the vibration source and the part of the body being treated, a fluid-filled member which is caused to vibrate so that, as soon as the fluid-filled member is brought into contact with the part of the body being treated, the vibratory oscillations from the fluid-filled member can act on the body. The vibratory oscillations of the fluid-filled member are soft fluid vibratory oscillations as compared with the harder vibratory oscillations of the solid material hitherto employed for transmitting the electrovibrations. The soft fluid vibration, as a peripheral action, is easily withstood by the autonomous nervous system, so that no complaints arise even if one part of the body is treated therewith for any prolonged period.

The vibratory oscillations supplied by the vibration source are taken over and passed on by the fluid-filled member on the hydraulic principle so that regardless of the size of the fluid-filled member, the fluid vibratory oscillations can be enjoyed to full effect anywhere over the surface of the fluid-filled member. For vibration of a fluid it is then in addition no longer necessary to apply such powerful sources of vibration as are needed to vibrate solid materials.

The fluid-filled member can be of any size and, as desired, it may be constructed in the form of any hollow body, such as flat, rounded, conical or elongated. In its form and size, the construction of the fluid-filled member can furthermore be governed substantially by the shape of the part of the body to be treated or to suit convenience in massage treatment.

The source of vibrations can be located anywhere on the outside of the fluid-filled member or even inside the fluid-filled member; for example it may be mounted at the side of a flat fluid-filled member on which, for massage purposes, the patient can stand, sit or lie. Another such example involves constructing the fluid-filled member in a hollow strip form for filling, so that for the massage treatment, the fluid-filled member can be wrapped around the joints of the feet, legs, hands or arms, for instance. In this case the vibration source is attached to the end of the strip.

Preferably, the fluid-filled member comprises a rubber bag filled with fluid. However, the fluid may also be enclosed in any materials, of varying degrees of elasticity, or even solid material. The fluid-filled member may even be enclosed in a combination of partly elastic and partly solid materials.

It is preferred that the fluid-filled member should have securing or attachment straps and loops, so that, for instance, the fluid-filled member can be so attached to the back of a chair whereby a patient can rest against it for back massage.

If the fluid is encased in an elastic material then, during massage, the part of the body treated can also be pressed or forced into or against the fluid-filled member.

To enhance vibratory massage, the surface of the casing may be undulating or otherwise formed, being for example ribbed or having projections in the form of beads.

A suitable fluid with which to fill the fluid-filled member is water, either pure or with additives, oils or any other fluid which will not harm the material of the fluid-filled member or the vibratory source, the varying degrees of viscosity of these fluids further differentiating the conversion of hard electrovibration into a kind of vibration which is more compatible with the body.

The fluid-filled member has a lockable filling aperture so that, as desired, the fluid can be filled into the member prior to massage treatment and be drained off again after massage treatment or be retained in the fluid-filled member, if required. For massage treatment involving a heating of the part of the body being treated at any time, fluid at the necessary temperature can be poured into the fluid-filled member. If the part of the body treated is to be cooled during vibratory massage, then the fluid-filled member may be filled with a fluid cooled as required, prior to massage treatment.

The fluid-filled member may be wholly or partly subdivided into chambers or may be provided on the inside with rib-like structures, for example, so that the subdivisions disperse or concentrate the sources of vibration.

An embodiment of the present invention provides for increasing the vibration by incorporating two or more vibration portions on the fluid-filled member in any desired locations, and the volume of the fluid-filled member can also be extended insofar as the whole of a person can lie on the fluid-filled member in order to provide a complete massage on a massage bed. This alternative embodiment is particularly important for patients who are confined to bed for prolonged periods, so that the human organism, weakened from prolonged confinement to bed, can be refreshed, and also to prevent bed sores.

Two, or any desired number of fluid-filled members may be utilized together, for example located in layers one on another or in any other desired arrangement. Where there are two or more sources of vibration on one fluid-filled member or when there are two or more fluid-filled members, a further differentiation or variation in the intensity of vibration can be achieved by switching individual sources of vibration on or off.

With the devices of this invention various advantages ensue. The electrovibration is transmitted to the human body in a way which is far more tolerable to the nervous system than with conventional devices, so that a greater depth of action is achieved, the vibration being found to be surprisingly pleasant and kind to the body, even if it is applied to just one part of the body for a long period. The additional possibility of cold or heat treatment during vibratory massage is thereby a tremendous aid to vibration. The shaping possibilities, so that the fluid-filled member can in size and shape be adapted to the shapes of the body and even as an elastic member can be adapted to the part of the body being treated, and the fact that the part of the body being treated can be pressed into the elastic fluid-filled member, improve and enhance the possible applications of electrovibration as a means of body massage.

The invention may be performed in various ways, and four preferred embodiments are shown, in partial cross-section, in the accompanying FIGS. 1 to 4 of the accompanying drawings, which will now be described.

FIG. 1 shows a fluid-filled member 1 constructed in a flat-round form as a vibration transmission member. A vibration source 3 as an integral vibration portion and a filling aperture 4 are provided integrally of the member 1 and a cable from the vibration source leads to an electrical supply plug 7. Two retaining straps 5 and two retaining loops 6 provide means for attaching the member 1 to a fixture such as a chair.

Figure 2:
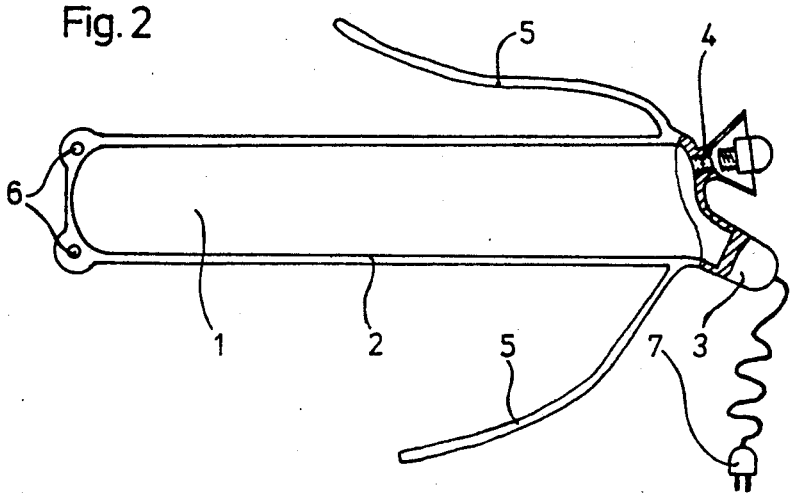

FIG. 2 shows a strip-like form of fluid-filled member 1 again provided with an integral vibration source 3 and a filling aperture 4 as well as two retaining straps 5 and two retaining loops 6 and a plug 7. The strip of this embodiment is very flexible and can be wrapped round a part to be massaged.

Figure 3:
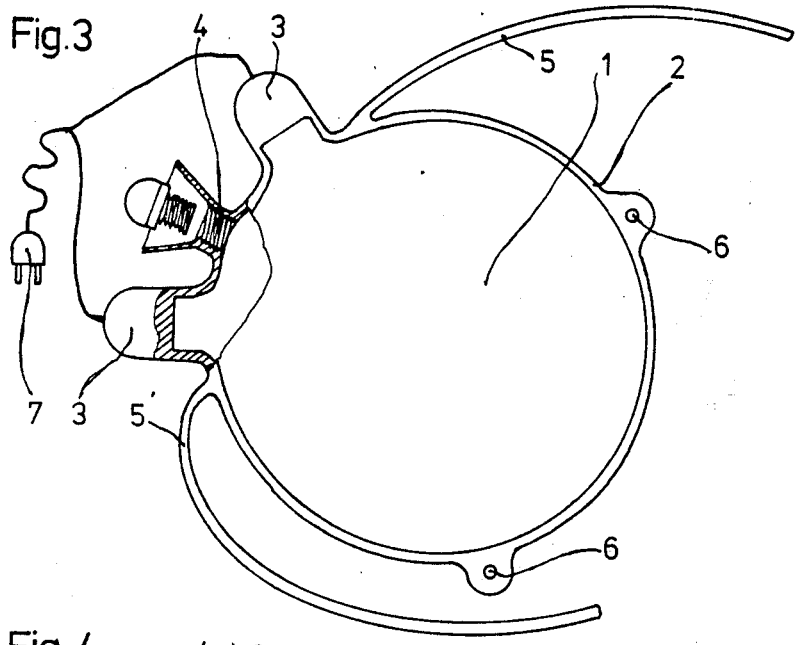

FIG. 3 shows a fluid-filled member 1 provided with two integral vibration sources 3, and again having a filling aperture 4, two retaining loops 6, two retaining straps 5 and a plug 7.

Figure 4:
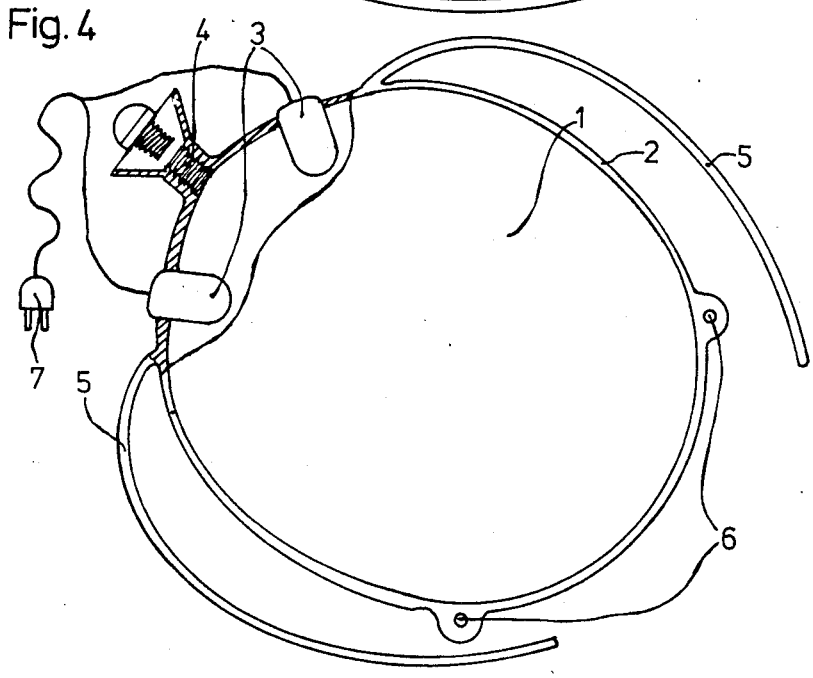

Finally FIG. 4 shows a fluid-filled member 1 with two internally mounted vibration sources 3 but which is otherwise of identical construction to that of FIG. 3.

The casings 2 of all forms of fluid-filled member 1 illustrated may consist wholly of elastic or non-elastic material, or may consist partly of elastic material and partly of non-elastic material. The preferred elastic material used is rubber. While all the embodiments illustrated employ fixed vibration sources 3, the vibration transmission members may incorporate a vibration portion to which an independent vibration source may be mounted.

I claim:

1. An accessory or transmission part for electrovibratory massage appliances, consisting of a fluid-filled member having a closable filling and drain aperture and rigidly or detachably connected to a source of vibration, and wherein the volume of fluid in the member is at least approximately five times greater than the volume of the electric vibration source.

2. An accessory or transmission part for electrovibratory massage appliances according to claim 1, wherein the casing of the fluid filled member consists of stretchable materials.

3. An accessory or transmission part for electrovibratory massage appliances, consisting of a fluid-filled member with a closable filling and drain aperature and rigidly or detachably connected to a source of vibration, and wherein as the accessory or transmission parts, a plurality of fluid-filled members are provided, the volume of fluid in each of these members being at least approximately five times greater than the volume of the electric vibration source.

4. An accessory or transmission part for electrovibratory massage appliances according to claim 3, wherein the casing of the fluid filled members consist of stretchable materials.

5. An accessory or transmission part for electrovibratory massage appliances according to claim 1, wherein the casing of the fluid filled member consists partly of stretchable and partly of non-stretchable materials.

6. An accessory or transmission part for electrovibratory massage appliances according to claim 3, wherein the casing of the fluid filled members consist partly of stretchable and partly of non-stretchable materials.

7. An accessory or transmission part for electrovibratory massage appliances according to claim 1, wherein the fluid filled member is rigidly or detachably connected to more than one vibration source.

8. An accessory or transmission part for electrovibratory massage appliances according to claim 7, wherein the vibration sources are located in some cases inside the fluid filled member and in some cases outside the fluid filled member.

9. An accessory or transmission part for electrovibratory massage appliances according to claim 1, wherein the vibration source is located inside the fluid filled member.

10. An accessory or transmission part for electrovibratory massage appliances according to claim 1, wherein the surface of the casing of the fluid filled member has rib-like or bead-shaped projections.

11. An accessory or transmission part for electrovibratory massage appliances according to claim 1, wherein the fluid-filled member is spherical or cylindrical in shape.

* * * * *